US007140290B2

(12) United States Patent
Borgwarth et al.

(10) Patent No.: US 7,140,290 B2
(45) Date of Patent: Nov. 28, 2006

(54) MORTAR DEPLOYMENT AND STORAGE SYSTEM

(75) Inventors: Dennis W. Borgwarth, Andover, MN (US); Ryan C. Lakeman, Maple Grove, MN (US); Bradley J. Breeggemann, Maple Grove, MN (US); Timothy J. Doering, Anoka, MN (US)

(73) Assignee: BAE Systems Land & Armanents L.P., Arlington, VA (US)

( * ) Notice: Subject to any disclaimer, the term of this patent is extended or adjusted under 35 U.S.C. 154(b) by 71 days.

(21) Appl. No.: 11/119,430

(22) Filed: Apr. 29, 2005

(65) Prior Publication Data

US 2005/0241468 A1 Nov. 3, 2005

Related U.S. Application Data

(60) Provisional application No. 60/566,587, filed on Apr. 29, 2004.

(51) Int. Cl.
*F41F 1/06* (2006.01)
*B60P 1/04* (2006.01)

(52) U.S. Cl. ..... 89/37.05; 89/1.35; 414/476

(58) Field of Classification Search ..... 89/37.01, 89/37.05, 40.02, 1.35; 212/169; 414/476, 414/482, 538

See application file for complete search history.

(56) References Cited

U.S. PATENT DOCUMENTS 1,789,530 A * 1/1931 McBride ..... 42/94
2,197,816 A * 4/1940 Tate ..... 89/40.02
4,489,639 A 12/1984 Winkler et al.
4,495,852 A * 1/1985 Winkler et al. ..... 89/46
4,548,122 A * 10/1985 Hansson et al. ..... 89/37.05
4,753,156 A 6/1988 Winkler et al.
4,785,711 A * 11/1988 Jackson ..... 89/43.01
4,791,852 A 12/1988 Fraud et al.
4,819,540 A * 4/1989 Jackson ..... 89/37.05
4,858,514 A * 8/1989 Argon ..... 89/37.05
6,000,313 A 12/1999 Becker et al.
6,009,791 A 1/2000 Medlin
6,116,846 A * 9/2000 Bulkley ..... 414/700
6,457,396 B1 * 10/2002 Bean et al. ..... 89/40.04
6,742,435 B1 * 6/2004 Staiert et al. ..... 89/40.13

FOREIGN PATENT DOCUMENTS

DE 0 179 753 A2 * 4/1986
DE 0 255 997 A2 * 2/1988

* cited by examiner

*Primary Examiner*—Michael J. Carone
*Assistant Examiner*—Bret Hayes
(74) *Attorney, Agent, or Firm*—Patterson, Thuente, Skaar & Christensen P.A.

(57) ABSTRACT

A system for stowing and deploying a mortar from a transport vehicle employs a hoist mechanism, a support frame, a pair of guide arms and a barrel-support strut attached to a transport vehicle. The support frame is adapted to be temporarily engaged with the mortar barrel, the base plate and the pair of stabilizer arms of the mortar to prevent relative motion between them during stowing and deployment. The hoist mechanism has a lift arm that pivots between a retracted and a deployed position. One end of the lift arm is hook shaped for detachable engagement with the support frame. A pair of guide arms extend in spaced parallel relation from the rear of the vehicle and serve to guide a trajectory of the mortar as it is being stowed or lowered to the ground.

27 Claims, 8 Drawing Sheets

MORTAR DEPLOYMENT AND STORAGE SYSTEM

RELATED APPLICATIONS

This application claims the benefit of U.S. Provisional Patent Application Ser. No. 60/566,587, filed Apr. 29, 2004, hereby fully incorporated herein by reference.

FIELD OF THE INVENTION

This invention relates to a mobile artillery system. The system is capable of stowing an artillery piece aboard a vehicle for transport, rapidly deploying it off the vehicle for use in the field and retrieving it after use for stowage aboard the vehicle. More particularly, the present invention relates to a mortar deployment and storage system.

BACKGROUND OF THE INVENTION

The conduct of modern military operations has necessitated the use of small mobile, combat units equipped for speed and agility. The need for mobility dictates the type of ground-based military equipment for such units. Weapons, which can easily be deployed, fired, retrieved and transported for redeployment to another location in the field, are particularly well suited for the needs of mobile military units.

Lightweight gun systems form an important part of the modern mobile arsenal. Mortars, such as the 120 mm mortar, are one example of a lightweight gun system that finds widespread use in a variety of military situations due to their lethality and range. Traditionally, the mortar assembly is disassembled into its constituent components for transport and then it is reassembled for use. Typically, the mortar has a base-plate that is relatively massive in comparison to the other components of the mortar. The mortar base plate is sometimes further equipped with orthogonal plates capable of digging into the soil to anchor the base-plate against movement due to recoil forces generated when the mortar is fired. While this arrangement ensures the mortar remains aimed to shoot at a desired trajectory, the arrangement is heavy thus precluding easy relocation. Furthermore, the base-plate can be hard to dislodge from its anchored position in the ground once firing has ceased and the gun needs retrieving for transport to another location.

Due to its weight and shape, the mortar is preferrably hauled on a vehicle for rapidly transporting the gun to desired locations on the battlefield. The transport vehicle may be a variety of wheeled or tracked vehicles and is selected based upon airlift capabilities, and the distances and terrain over which mortar will be moved. For example, the transport vehicle may be a conventional pick-up truck, an all-terrain vehicle, or a trailer with the ability to carry the mortar assembled or unassembled and a plurality of the rounds that are used with the mortar.

One common way for transporting a mortar is by disassembling it and fastening it to harnesses on the vehicle, such as an armored vehicle. The mortar is removed from the vehicle and assembled on the ground in the vicinity of the vehicle for fire missions. One skilled in the art will recognize that heavy mortar components will take considerable effort and time to assemble. Similar effort and time are required to disassemble and store the mortar components on a vehicle after a fire mission. This time may be critical if the crew is in hostile environment.

In order to improve transportability and operability, some designs incorporate adding a tilt bed to the vehicle on which the mortar is mounted. The components that assist in loading and unloading of the mortar on and off the tilt bed are generally human powered. A currently fielded method employs a trailer to store the mortar but uses human power to load and unload the mortar.

Alternatively, a vehicle may be provided with a support arrangement for a fully assembled mortar, which in the combat-ready position is arranged between the vehicle and the ground. The support arrangement is disposed at the tail of the vehicle and when deployed presses against the ground with a defined force so as to relieve the undercarriage of the vehicle from recoil forces generated by the firing of the artillery. This alternate design requires an increased structural complexity and limits independent use of the vehicle.

Another drawback to these common techniques is the inability to separate the mortar from the transport vehicle. When the vehicle remains connected to the mortar during fire missions the effectiveness of both components are reduced. An easily deployed mortar allows a crew to perform a fire mission while the vehicle be used for other missions. Moreover, a stand-alone mortar is easier to camouflage than a vehicle, thus making both components more survivable. The modularity adds to the crew's ability to abandon a possibly inoperative or damaged mortar in making a getaway.

In essence, the emphasis in the prior art is on the modification of a vehicle to outfit it for a specific piece of artillery. However, there is a need to equip a generic military or civilian vehicle for storing, transporting and deploying a mortar and provide other features commonly available on custom modified artillery carriers of the prior art without incurring the cost for specially designed parts and extensive customization of the vehicle and/or the mortar.

Therefore, it would be advantageous to provide an assembled mortar that can be transported by vehicle to a desired firing location, rapidly detached from the vehicle and rapidly reattached upon completion of the fire mission. To improve the survivability of the unit and equipment in battle, the vehicle should have all-terrain capability. The combination of the mortar and an all-terrain vehicle has the potential of providing the requisite degree of lethality and survivability if the two could be integrated without compromising the tactical advantage each component bestows on a combat unit.

SUMMARY OF THE INVENTION

According to a general embodiment of the present invention, there is provided a lightweight system for rapidly stowing or deploying a mortar on or off a transport vehicle or trailer. The present invention is also a method for traversing the rear section of a transport vehicle with a completely assembled mortar by immobilizing the mortar elements and guiding the mortar to the ground and then back into the vehicle. The system comprises a hoist mechanism, a pair of guide arms and a barrel-support strut all of which are mounted to a transport vehicle. The system further comprises a support frame which is independently connected to the mortar. The support frame is adapted to be temporarily engaged with the mortar barrel, the base plate and the pair of stabilizer arms of the mortar to prevent relative motion between them during stowing and deployment. The hoist mechanism has a lift arm that pivots between a retracted and a deployed position. One end of the lift arm is hook shaped and is removably engaged with the support frame for causing the support frame with the mortar attached to be guided from a stowed position aboard the vehicle to an operational position on the ground. Further, a pair of guide arms are attached to the rear of the vehicle and extend in spaced parallel relation away from the vehicle. The guide arms provide a cam surface to guide the mortar around the rear of the vehicle, as it is being hauled into the stowed position or lowered to the ground from the transport vehicle.

DETAILED DESCRIPTION OF THE PREFERRED EMBODIMENTS

Figure 1:
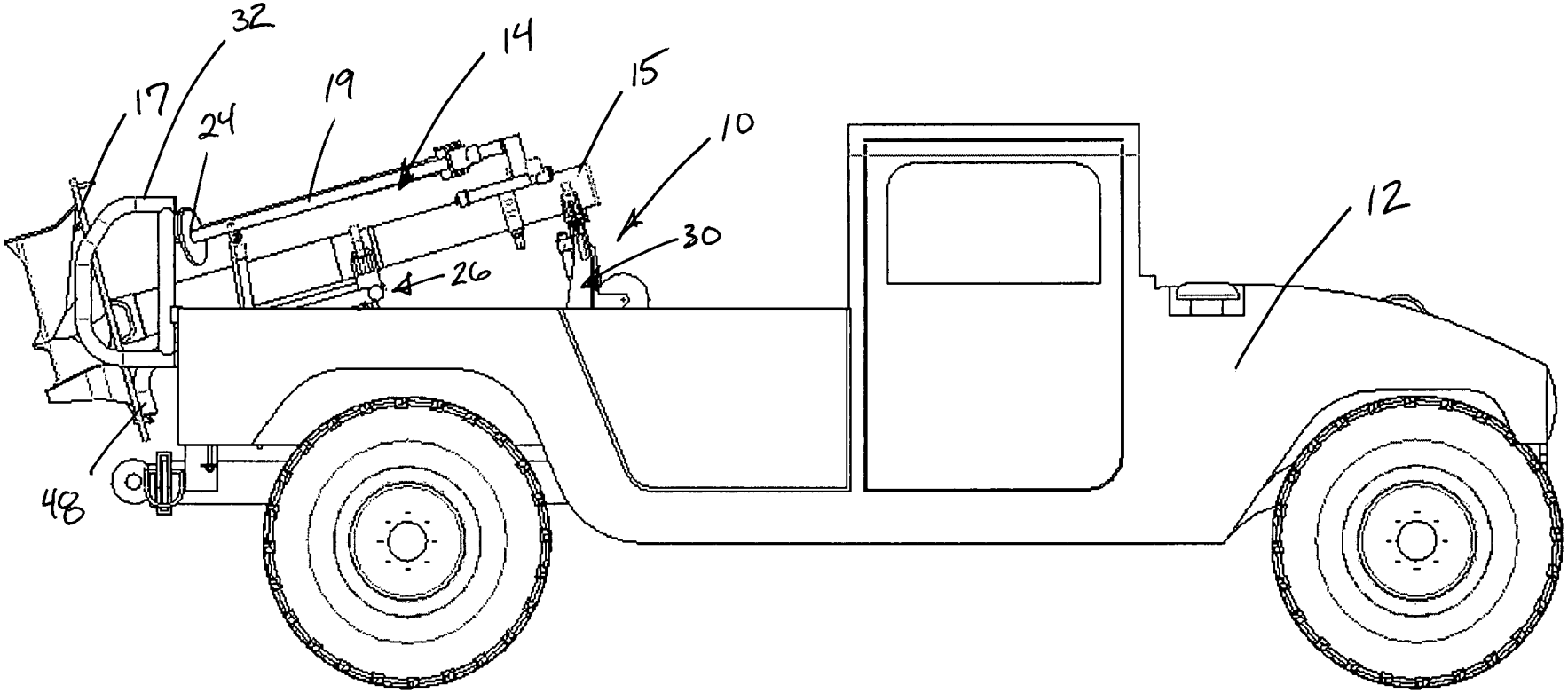
FIG. 1 is a side view of a mortar deployment and storage system in a retracted position on a preferred transport vehicle.
Figure 2:
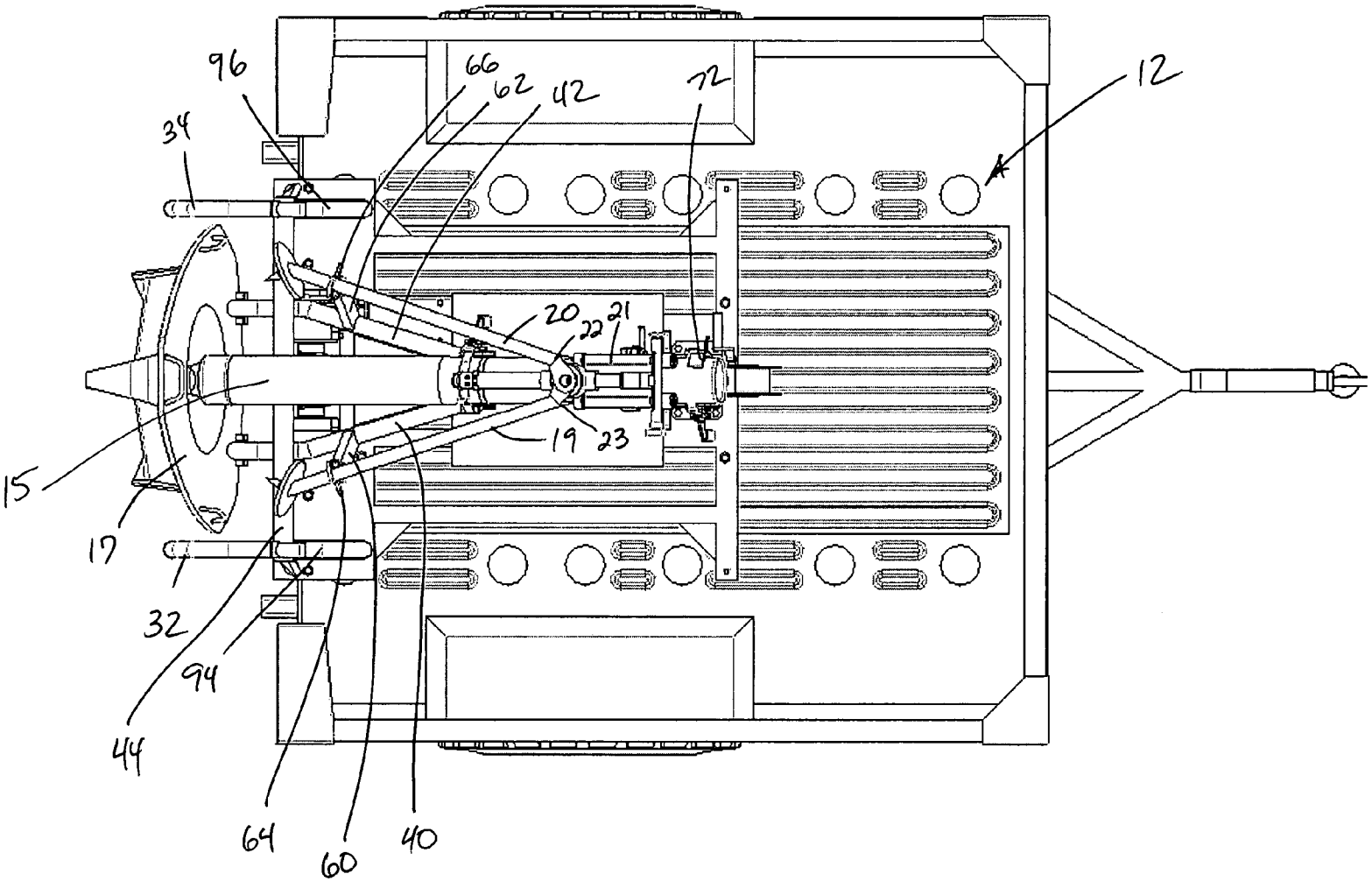
FIG. 2 is a top view of the mortar deployment and storage system in the retracted position on a trailer.
Figure 3:
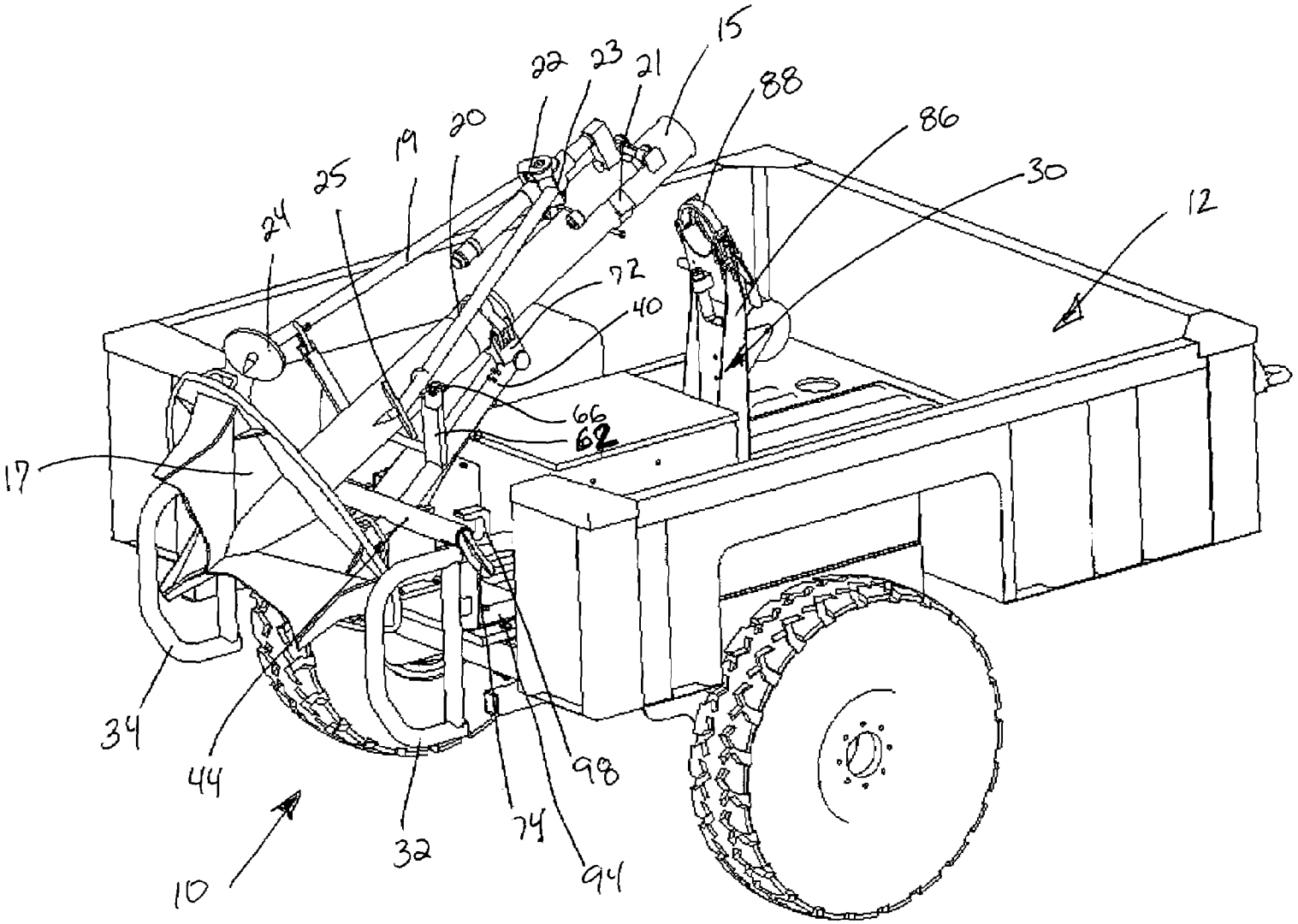
FIG. 3 is a perspective view of the mortar deployment and storage system with the mortar moving out of engagement with barrel clamp of the barrel-support strut.
Figure 5:
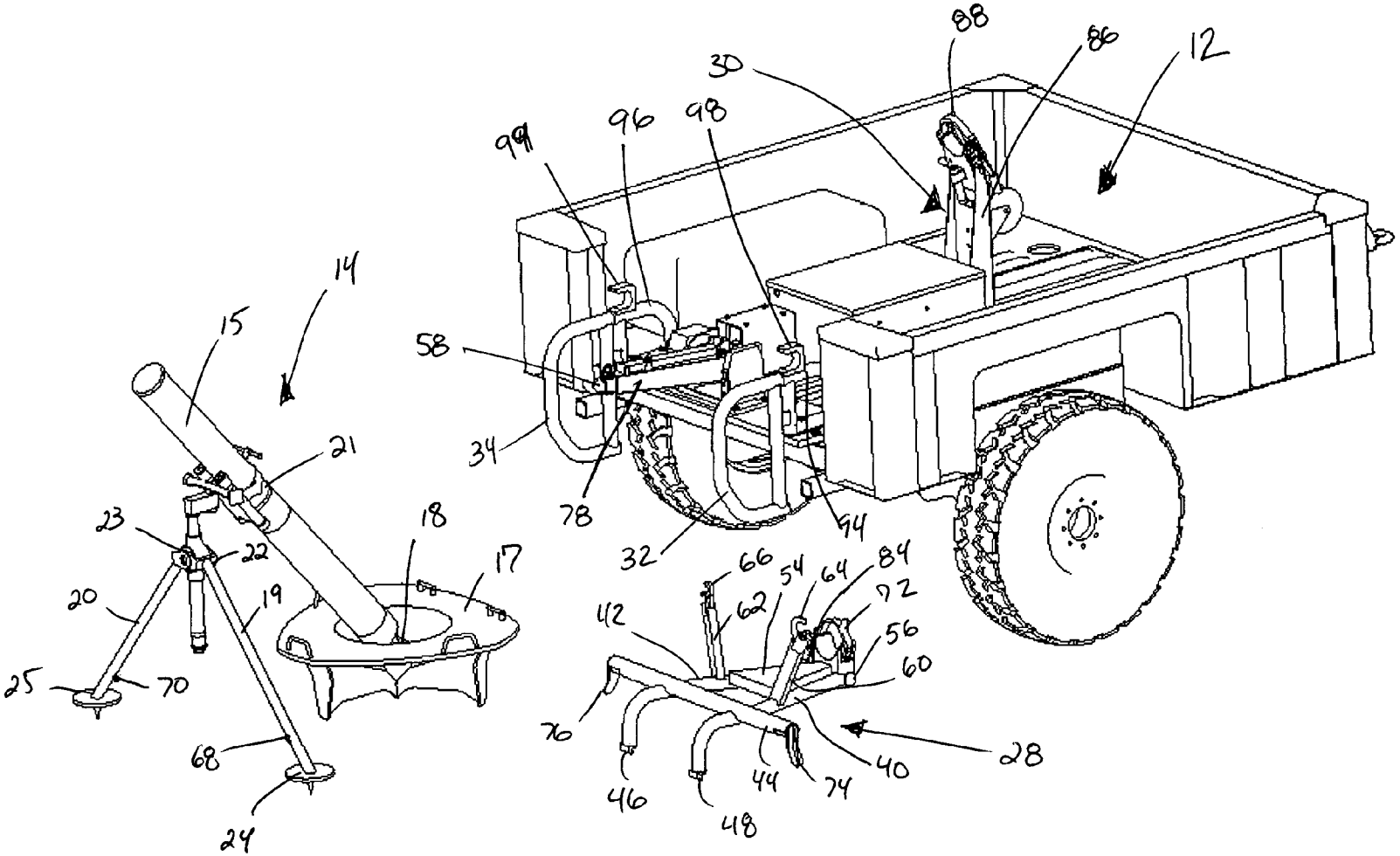
FIG. 5 is a perspective view of the mortar deployment and storage system with the support frame detached from the mortar.
Figure 6:
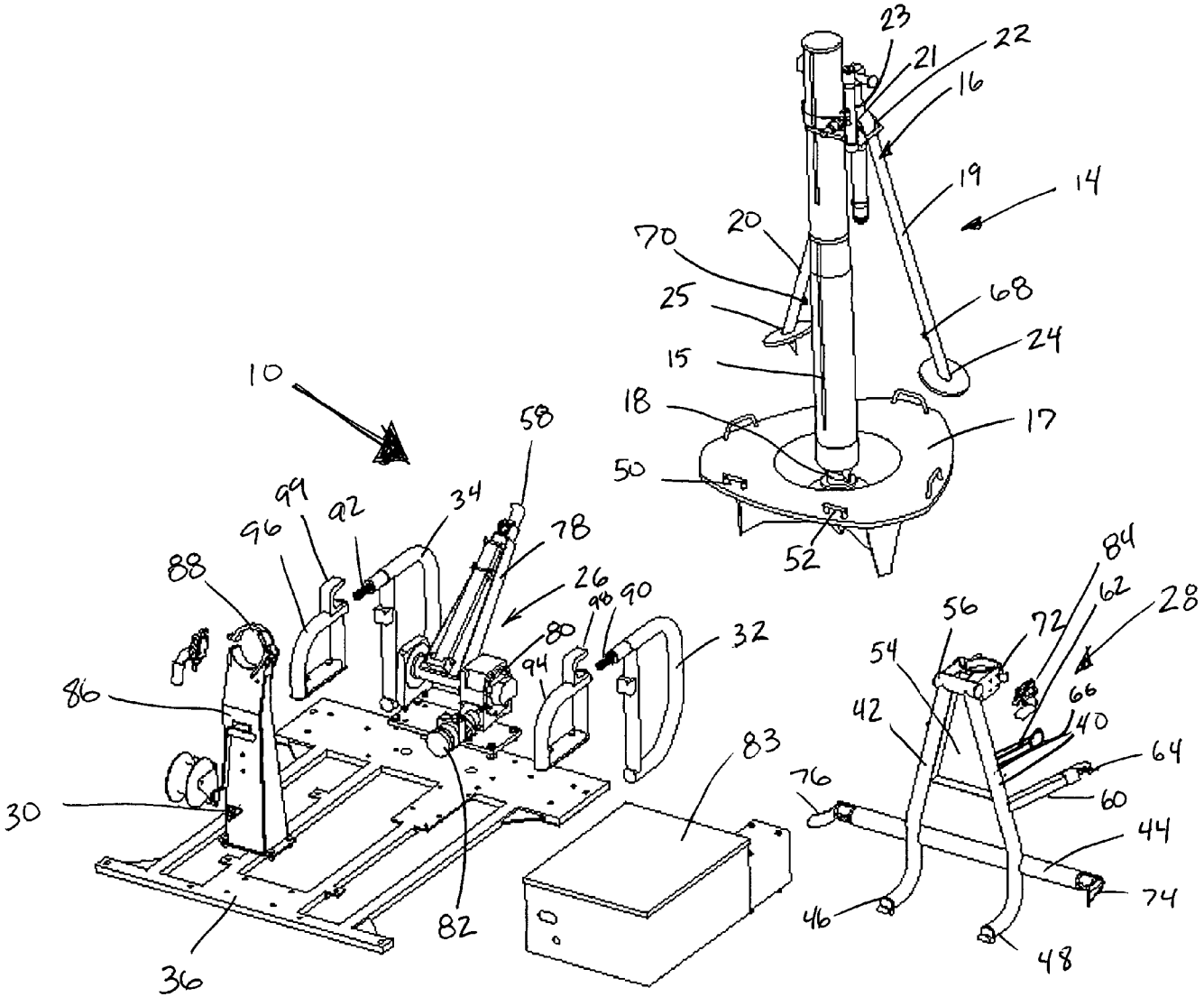
FIG. 6 is an exploded view of the mortar deployment and storage system.
Figure 7:
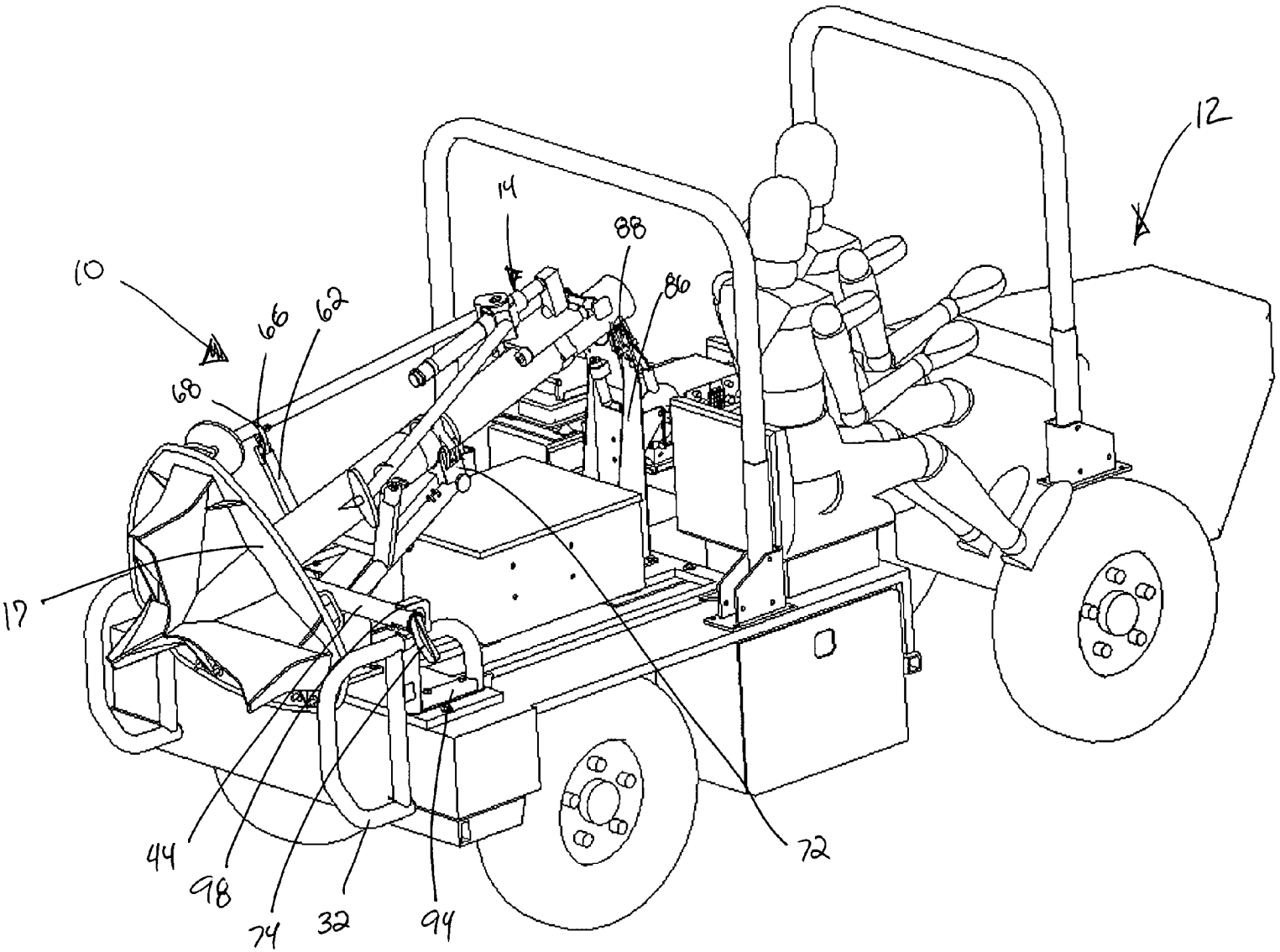
FIG. 7 is a perspective view of the mortar deployment and storage system used in conjunction with another transportation vehicle.

The present invention is directed to a mortar deployment and storage system 10, as illustrated in FIGS. 1–8. Mortar deployment and storage system 10 has an integrated configuration so that it can be fitted onto a transport vehicle 12, such as a truck as illustrated in FIGS. 1 and 7, with only a minimal modification to the original vehicle configuration. It is also envisioned that the present invention 10 may be disposed on a transport vehicle 12 such as a trailer, as shown in FIGS. 2–5, or other suitable transports.

The preferred transport vehicle 12 aboard which mortar deployment and storage system 10 is mounted is designated a M998/1038 Series High-Mobility Multipurpose Wheeled Vehicles ("HMMWV," or "Humvee," or "Hummers") cargo/troop carrier manufactured by AM General. The United States Army uses vehicles such as the HMMWV to transport equipment, materials, and/or personnel. Although described in relation to a M998/1038 HMMWV, the mortar deployment and storage system 10 of the present invention can just as will be incorporated into other HMMWV models without deviating from the invention. Such other models may include, but are not limited to, the M966—TOW Carrier, armored; M1036—TOW Carrier with winch, armored; M1045—TOW Carrier with supplemental armor; M1046—TOW Carrier with winch and supplemental armor; M1025—Armament Carrier, armored M1026—Armament Carrier with winch, armored; M1043—Armament Carrier with supplemental armor, M1044—Armament Carrier with winch and supplemental armor; M1037—S250 Shelter Carrier, M1042—S250 Shelter Carrier with winch. Detailed specifications of the above noted transport vehicles 12 are well known to those skilled in the art. As a general matter, the present invention 10 is disposed onto the subframe 36 of the vehicle cargo bed 38.

As illustrated in FIG. 6, the mortar deployment and storage system 10 of the present invention comprises a hoist mechanism 26 for raising and lowering the mortar 14, a support frame 28 for immobilizing the mortar 14, a barrel support strut 30 for further constraining the mortar in the stowed position, and a pair of guide arms 32, 34 for directing mortar 14 travel during deployment and storage.

As illustrated in FIGS. 1–8, mortar 14 includes a barrel 15, bipod 16, and base-plate 17. Barrel 15 is operably coupled to the base-plate by means of a swivel joint 18. Bipod 16 comprises a pair of foldable stabilizers 19, 20 connected to bipod collar 21 at first stabilizer-ends 22, 23. Bipod collar 21 can be adjustably slid over barrel 15 and locked at a desired position along it. Second stabilizer-ends 24, 25 of stabilizers 19, 20 respectively extend from the barrel 15 to rest on the ground generally forward of the ground-engaging base-plate 17, spaced apart from each other and the base-plate 17 to retain the barrel 15 in a generally vertical orientation for aiming the barrel 15 towards a desired target.

In a first embodiment of the present invention mortar deployment and storage system 10 includes a support frame 28 shaped and dimensioned to restrain mortar barrel 15, stabilizers 19, 20, and base-plate 17 against motion relative to each other so that the mortar 14 and the support frame 28 can be moved as a single unit into and out of vehicle 12. Referring to FIG. 6, support frame 28 includes side strut members 40, 42 and mortar guide strut 44 in an "A" frame relationship. Remote ends of side strut members 40, 42 terminate in abutment flanges 46, 48 that interface with base-plate 17 at spaced apart mortar base-plate brackets 50, 52. A plate 54 is secured to cross member 56 and side strut members 40, 42 at an upper proximal portion of the side strut members 40, 42. Plate 54 may be joined to the cross member 56 and the side strut members 40, 42 by any process known in the art. In a preferred embodiment, plate 54 is welded to the cross member 56 and the side strut members 40, 42. The plate 54 provides torsional rigidity to the support frame 28 and provides a backstop for lift arm hook 58 when it engages the cross member 56 thereby protecting the mortar barrel 15 from damage. Cross member 56 is operably coupled to a barrel support-bracket 72 suited to cradle and releasably capture a portion of the barrel 15. Connector struts 60, 62 are secured to the side strut members 40, 42 and extend outward from them at an angle to plate 54 to terminate in first and second connector latches 64, 66. Connector latches 64, 66 are adapted for being releasably secured to mortar stabilizers 19, 20 at stabilizer restraint points 68, 70.

Mortar guide strut 44 extends cross-wise to elongate side strut members 40, 42 below cross member 56. The mortar guide strut 44 extends between and beyond the space spanned by side strut members 40, 42 to form L-shaped short struts 74, 76 that as will be described below, guide the mortar 14 during deployment and stowing.

Support frame 28 engages with mortar 14 at base-plate brackets 50, 52 by means of abutment flanges 46, 48; stabilizers 19, 20 by means of connector latches 64, 66; and the barrel 15 by means of barrel support-bracket 72 so as to substantially restrain the mortar 14. Support frame 28 and mortar 14 will then be disposed to move together as one unit.

The mortar storage and deployment system 10 also includes hoist mechanism 26 for rapidly moving the mortar 14 from the stowed position onboard the transport vehicle 12 to the firing or deployed position. The hoist mechanism 26 is also used to free the base plate 17 from the ground after a fire mission. The hoist mechanism 26 is best viewed in FIG. 6. In a general embodiment of the present invention 10, hoist mechanism 26 includes a lift arm 78, a gearbox 80 and a motor 82 that pivotally attaches the lift arm 72 to transportation vehicle 12. Motor 82 is preferably a conventional winch motor such as mounted to subframe 36 of cargo bed 38 of the transport vehicle 12. Motor 82 is powered by battery system 83. The winch may also be a hydraulically powered device. Distal end of lift arm 72 preferably includes a hook 58, for operably engaging mortar 14 immobilized within support frame 28. In this regard, cross member 56 is provided with a perforated bracket 84 having at least one perforation suitable for engaging hook 58. In the stowed position, the mortar 14 is loaded aboard the transport vehicle 12 with the base-plate 17 resting on the subframe 36 and the barrel 15 positioned at an inclination to the cargo-bed 38.

As illustrated in FIG. 6, a barrel-support strut 30 is mounted to the subframe 36. Barrel support strut 30 includes support post 86 terminating at barrel clamp 88 for locating and removably clasping the barrel 15 of the mortar 14 when in the stowed position aboard the transport vehicle 12. Barrel clamp 88 extends around barrel 15 when mortar 14 is in the stowed position to reduce the potential of the components of the mortar 14 being damaged as transport vehicle 12 is moved.

Mortar storage and deployment system 10 also includes a pair of guide arms 32, 34 as depicted in FIG. 6. Each guide arm 32, 34 extends in spaced apart parallel relation from the rear of transport vehicle 12 and is mounted to subframe 36, through pivot point 90, 92 that extend for connection with guide arm supports 94, 96. Guide arms 32, 34 pivot between a raised position remote from the ground and a lowered position proximate the ground. The guide arms 32, 34 each preferably have a generally D-shaped configuration. Guide arm supports 94, 96 include at the upper side a C clamp 98, 99 for capturing mortar guide strut 44. Moving the guide arms 32, 34 to the raised position increases the ground clearance of transport vehicle 12 to reduce the potential of the guide arms 32, 34 being damaged while the transport vehicle 12 is moved.

Guide arms 32, 34 are rotated to the lowered position when the mortar 14 is being moved to or from the stowed position. When the mortar 14 (captured within the support frame 28) is being hoisted with the guide arms 32, 34 in the lowered position, L-shaped short struts 74, 76 of mortar guide strut 44 enter into sliding contact with the guide arms 32, 34 to restrain mortar 14 from swaying transverse to the path followed by lift arm 78. Guide arms 32, 34 also prevent mortar base-plate 17 from sliding underneath transport vehicle 12 when the mortar 14 is being moved into the stowed position.

Figure 4:
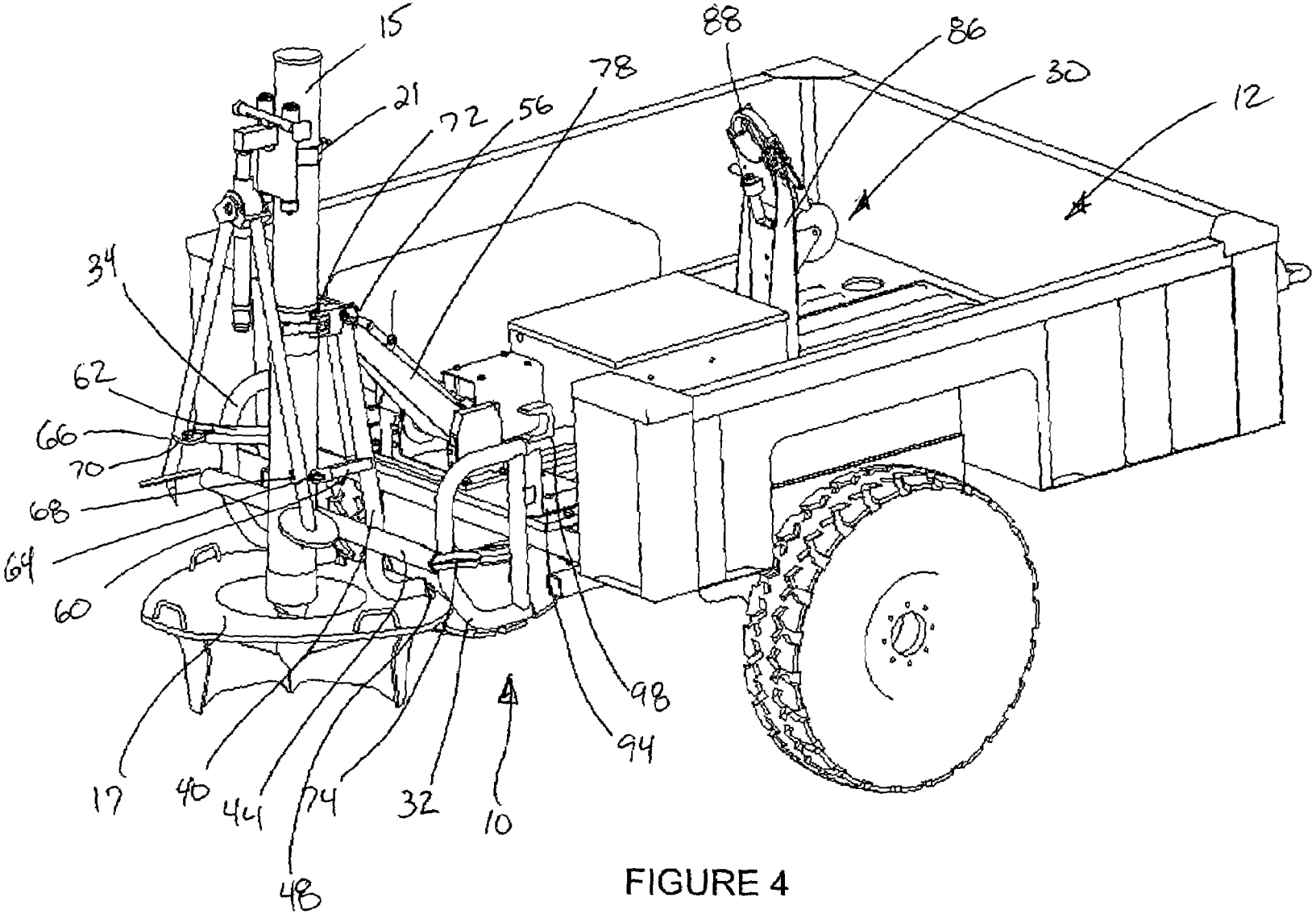
FIG. 4 is a perspective view of the mortar at an intermediate stage of deployment.

In use, the transport vehicle 12 is moved to a desired use location with the mortar 14 in the stowed position, as illustrated in FIG. 1. The hoist mechanism 26 is then activated whereby the lift arm 78, powered by motor 82, pivots from the retracted position to the deployed position. The rotation of lift arm 78 causes hook 58 to move along an arc whereby the mortar 14 and support frame 28 combination moves from the stowed position along an arcuate trajectory into the use position on the ground, as illustrated in FIG. 4. The lift arm 78 is sized to have a length that permits the hook 58 to move out of engagement from within the perforation bracket 84 when the mortar 14 rests substantially on the ground. Transport vehicle 12 is then driven away from the mortar 14 before the support frame 28 is disengaged to free the mortar 14 for configuration into a firing position. It is envisioned that outrigger supports may be extended from the vehicle to provide stability during movement of the lift arm. When lift arm 78 is in the extended position, the base-plate 17 of mortar 14 is on the ground so that lift arm 78 is separable from support frame 28. Guide arms 32, 34 are pivoted to the raised position and transport vehicle 12 may thereby be driven away from mortar 14.

FIG. 5 illustrates the detachable nature of support frame 28. Once the mortar 14 is located in the fire or use position, support frame 28 is detached from mortar 14 and the stabilizers 19, 20 are pivoted away from barrel 15 to ready the mortar 14 for firing. After firing the mortar 14, the steps described above are essentially carried out in a reverse order to store the mortar 14 on the transport vehicle 12 in the stowed position. Lifting the mortar 14 off the ground surface using hoist mechanism 26 is particularly helpful when the mortar 14 is used on soft ground surfaces as the base-plate 17 may become partially buried in the ground as a result of the recoil.

Figure 8:
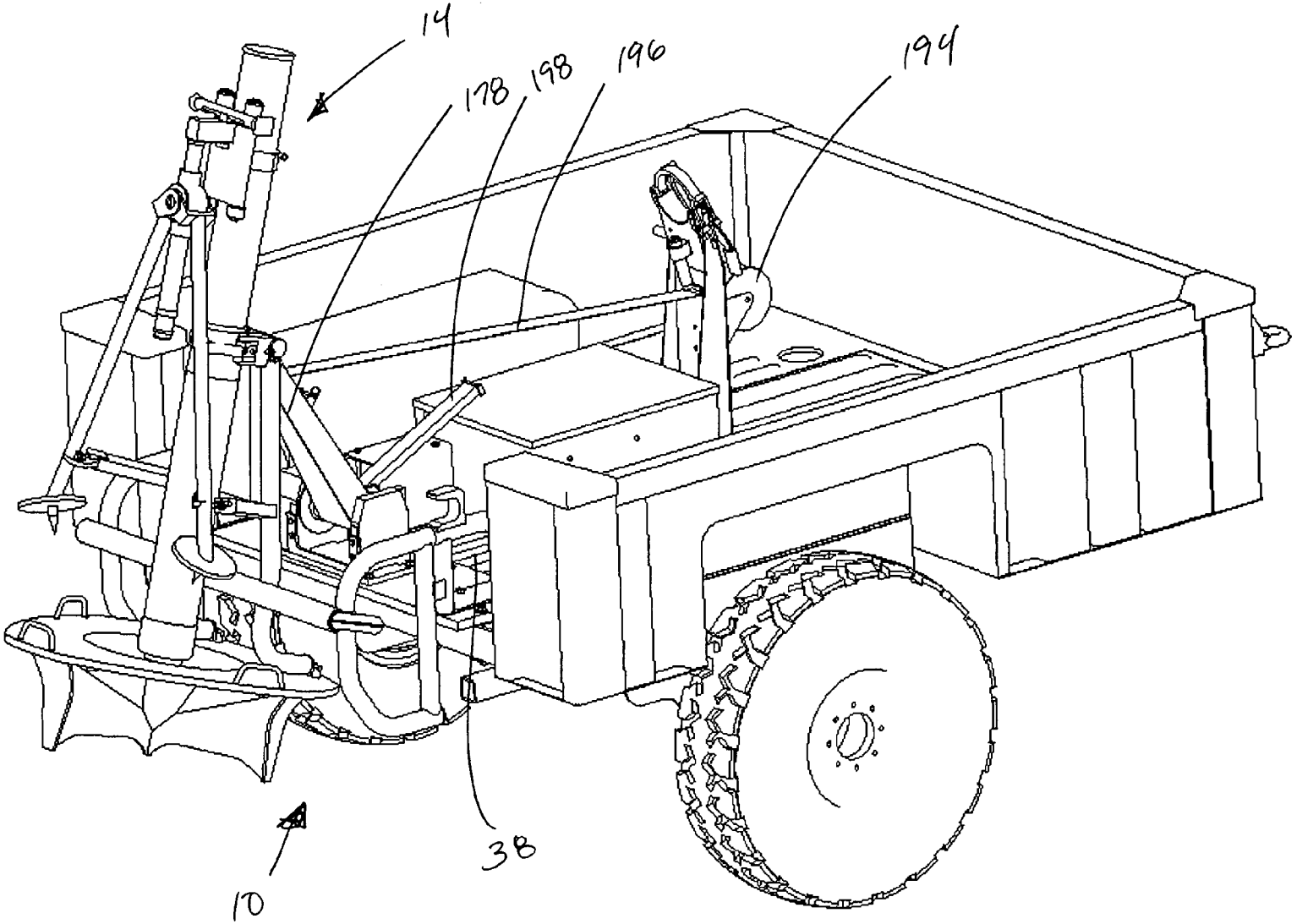
FIG. 8 is a perspective view of the mortar deployment and storage system with a hand crank actuator for lifting the mortar.

Another exemplary embodiment of the present invention is illustrated in FIG. 8. A hand operated crank 194 may be operably attached to the lift arm 178 by means of a flexible strap 196 and a strap-guide-strut 198. Turning the hand crank 194 causes pivoting movement of the lift arm 178 and also serves to bring the strap-guide-strut 198 into guiding engagement with the strap 196 to keep the strap 196 from coming into contact with the cargo-bed 38 or the lift arm 182.

As mortar 14 is transported in an assembled configuration, the time needed to prepare the mortar 14 for firing is significantly reduced when compared to the traditional systems where the mortar 14 is separated into several components for transportation. Since mortar 14 is detached from the transport vehicle 12 during firing, the transport vehicle 12 does not encounter any recoil when the mortar 14 is fired. Accordingly, it is not necessary for the transport vehicle 12 to be designed to withstand the forces generated during firing. For example, the transportation vehicle 24 can have a lighter weight construction.

Mortar 14 used in conjunction with the present invention may be any bore size but the present invention is most appropriate for heavier models such as the 120-millimeter mortar. While the present invention is particularly suited for use with mortars, a person of ordinary skill in the art will appreciate that the concepts of the present invention may be utilized in transporting a variety of different objects. It is contemplated that features disclosed in this application, as well as those described in the above applications incorporated by reference, can be mixed and matched to suit particular circumstances. Various other modifications and changes will be apparent to those of ordinary skill.

What is claimed is:

1. A system for stowing and deploying a mortar from a transport vehicle, the mortar including a barrel mounted to a base-plate at a first end and a pair of stabilizers extending from the barrel proximate the second end, the system comprising:

a support frame adapted to be removably attached to the mortar;

a lift arm operably coupled to the transport vehicle at a first end for pivoting movement about a first axis, the lift arm including a connector for selectively engaging the support frame; and a pair of adjustable guide arms operably mounted on the vehicle proximate the lift arm, said pair of adjustable guide arms providing an arcuate track for the support frame as the mortar traverses a rear section of the transport vehicle.

2. The system of claim 1 wherein the support frame comprises:

a cross member adapted to engage the lift arm and a barrel clamp suited to releasably secure the barrel of the mortar;

a first and second side strut secured to the cross member at a first end and having a second end that includes a first and second abutment flange for interfacing with the base-plate, said first and second side struts further including first and second connector struts extending from the first and second side struts to connect with stabilizers of the mortar;

a plate secured to the cross member and first and second side strut to maintain the first and second side strut in spaced apart relationship; and a mortar guide strut secured to first and second side strut proximate the abutment flange, the mortar guide strut including at opposing ends a first and second L-shaped strut for engagement with the guide arms as the mortar traverses the rear section of the transport vehicle.

3. The system of claim 1 wherein the adjustable guide arms have a generally D-shape configuration with aligned arcuate portions extending in spaced parallel relation away from the transport vehicle, the arcuate portions providing a camming surface adapted to enter into temporary engagement with at least a portion of the support frame to guide the travel of the mortar while the lift arm is being pivoted between the deployed and the retracted position.

4. The system of claim 3 wherein the adjustable guide arms are pivoted about a guide arm support, said guide arm support fixed to the transport vehicle.

5. The system of claim 4 wherein the guide arm support includes a hook positioned to block the movement of the mortar guide strut when the lift arm is at a deployed position.

6. The system of claim 1 wherein the transport vehicle is a self propelled vehicle of a towed vehicle.

7. The system of claim 1 wherein the lift arm is coupled to a motor mounted on the vehicle for powering selective movement of the mortar between the deployed and the stowed positions.

8. The system of claim 1 wherein the lift arm is operatively coupled with a hand crank by way of a strap to selectively rotate the lift arm about the first axis so as to move the mortar between the deployed position and the stowed position.

9. The system of claim 8 wherein a strap guide is disposed to prevent the strap from contact with lift arm.

10. The system of claim 1 wherein the connector of the lift arm is a hook adapted to detachably engage the support frame.

11. The system of claim 1 wherein the transport vehicle is equipped with a cargo bed extending between a front end and a rear end of the vehicle along a longitudinal axis of the vehicle, the lift arm mounted with the first axis disposed substantially parallel to the longitudinal axis.

12. The system of claim 11 wherein the cargo bed includes accommodations for the storing of ammunition suitable for use with the mortar.

13. The system of claim 11 wherein the cargo bed includes at least one drop down outrigger arm disposed proximate the rear end of the cargo bed, the outrigger arm being selectively deployable in a ground engaging mode for providing stability to the vehicle during operations for stowing and deploying of the mortar from the bed.

14. The system of claim 11 wherein the cargo bed includes a mortar barrel support strut, said mortar barrel support strut mounted to a subframe of the cargo bed at a first end and including a mortar barrel clamp at a second end.

15. A method of traversing a rear section of a vehicle with a fully assembled mortar, said mortar including a base plate attached to a first end of a mortar barrel, the barrel articulated with a pair of stabilizer arms, the method comprising the steps of:

a) assembling the mortar;

b) immobilizing the mortar so that the base plate, the barrel and the stabilizer arms are connected to a support frame whereby the base plate, the barrel, the stabilizer arms and the support frame move as a unitary body;

c) rotating a pair of guide arms into a guide position from a stowed position;

d) pivoting a lift arm to a deployed position from the stowed position, the lift arm being operably coupled to the transport vehicle for pivoting movement about a first axis between the stowed position and the deployed position, the lift arm configured to be detachably engaged to the support frame for moving the mortar between a stowed position onboard the vehicle and the deployed position off the vehicle;

e) aligning the support frame with the guide arms for substantially constraining the travel of the mortar within a predefined path as the lift arm is extended to the deployed position;

f) disconnecting the lift arm from the support frame; and f) removing the support frame from the mortar.

16. A method of claim 15 wherein the lift arm can be used to free the base plate after a fire mission when said base plate becomes partially buried due to a recoil force generated by firing the mortar.

17. A method of claim 15 further including securing a barrel clamp to the barrel when the mortar is in the stowed position and unsecuring the mortar clamp prior to pivoting the lift arm for deploying the mortar, said mortar clamp extending from a mortar guide strut disposed on a cargo bed of the vehicle.

18. The method of claim 15 wherein the step of substantially constraining the travel of the mortar within predefined limits includes causing the mortar to follow a trajectory wherein all points of the mortar move in substantially parallel planes normal to a first axis and the mortar remains substantially free of contact with the transport vehicle between the deployed position and the stowed position.

19. The method of claim 15 wherein the guide arms include a pivot connection, said pivot connection mating with a guide arm support, said guide arm support disposed on the transport vehicle.

20. The method of claim 19 wherein the guide arms have a D shape to direct the mortar in the support frame around the rear section of the vehicle.

21. The method of claim 15 wherein the support frame includes a pair of side struts that slidingly engage the guide arms so as to substantially restrain a swinging motion of the mortar and support frame during the step of pivoting the lift arm.

22. The method of claim 15 wherein the step of pivoting the lift arm includes coupling the lift arm to a motor for powering movement of the mortar between the use and the stowed positions.

23. The method of claim 15 wherein the step of pivoting the lift arm includes coupling the lift arm to a hand winch for powering movement of the mortar between the deployed position and the stowed position.

24. The method of claim 15 wherein the lift arm includes a hook, said hook mating with a bracket suitably disposed on the support frame.

25. A vehicle with a mortar deployment and storage system, said system for moving a fully assembled mortar into and out of a vehicle, the mortar including a base plate attached to a first end of a mortar barrel, the barrel articulated with a pair of stabilizer arms, the system including:

means for immobilizing the fully assembled mortar so that said mortar can be moved as a unit;

means for transporting the mortar from a stowed position on the vehicle to a deployed position off of the vehicle or transporting the mortar from a deployed position on the vehicle to a stowed position.

26. A vehicle with a mortar deployment and storage system of claim 25 wherein means for immobilizing the mortar includes a support frame, said support frame comprising:

a cross member with a barrel clamp suited to releasably secure the barrel of the mortar;

a first and second side strut secured to the cross member at a first end and having a second end that includes a first and second abutment flange for interfacing with the base-plate, said first and second side struts further including first and second connector struts extending from the first and second side struts to connect with stabilizers of the mortar;

a plate secured to the cross member and first and second side strut to maintain the first and second side strut in spaced apart relationship; and a mortar guide strut secured to first and second side strut proximate the abutment flange, the mortar guide strut including at opposing ends a first and second L-shaped strut.

27. A vehicle with a mortar deployment and storage system of claim 26 wherein means for transporting the mortar from a stowed position on the vehicle to a deployed position off of the vehicle includes a lift arm operably coupled to the vehicle at a first end for pivoting movement about a first axis, the lift arm including a connector for selectively engaging the support frame; and a pair of adjustable guide arms operably mounted on the vehicle proximate the lift arm, said pair of adjustable guide arms providing an arcuate track for the support frame as the mortar traverses a rear section of the transport vehicle.

* * * * *